US008477982B2

(12) United States Patent
Reginaldo

(10) Patent No.: US 8,477,982 B2
(45) Date of Patent: Jul. 2, 2013

(54) NOISE-VIBRATION MICROPHONE STAND

(75) Inventor: Alberto N. Reginaldo, Orchard Lake, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 284 days.

(21) Appl. No.: 12/983,602

(22) Filed: Jan. 3, 2011

(65) Prior Publication Data

US 2012/0170785 A1 Jul. 5, 2012

(51) Int. Cl.
*H04R 9/08* (2006.01)
*H04R 11/04* (2006.01)

(52) U.S. Cl.
USPC ..... 381/368; 381/363

(58) Field of Classification Search
USPC .. 381/361, 363, 368; 84/327, 421; 248/122.1; 211/171, 173–175, 207, 208
See application file for complete search history.

(56) References Cited

U.S. PATENT DOCUMENTS

| | | | | |
|---|---|---|---|---|
| 3,653,625 | A * | 4/1972 | Plice | 381/368 |
| 4,141,452 | A | 2/1979 | Martin et al. | |
| 5,094,415 | A | 3/1992 | Revette et al. | |
| 5,120,012 | A | 6/1992 | Rosenau | |
| 6,533,232 | B1 | 3/2003 | Aggeler | |
| 7,390,950 | B2 * | 6/2008 | Hollander | 84/453 |
| 7,540,566 | B2 * | 6/2009 | Struzzieri | 297/337 |
| 8,218,807 | B1 * | 7/2012 | Johnson | 381/361 |
| 2006/0043030 | A1 * | 3/2006 | Rishar | 211/175 |
| 2006/0070445 | A1 | 4/2006 | Juber et al. | |
| 2006/0158836 | A1 | 7/2006 | Phillips | |
| 2010/0202624 | A1 | 8/2010 | Makinen et al. | |

* cited by examiner

*Primary Examiner* — Brian Ensey
(74) *Attorney, Agent, or Firm* — Gifford, Krass, Sprinkle, Anderson & Citkowski, P.C.

(57) ABSTRACT

The present invention discloses a noise-vibration (NV) microphone stand for holding an NV microphone a predetermined distance from a surface that the NV microphone stand is attached to. The NV microphone stand can include a rod having an attachment end that is operable to attach to the surface to be tested and with the rod extending away from the surface. In addition, an arm can be attached to and extend from the rod, the arm having an NV microphone bracket spaced apart from the rod. The NV microphone bracket can have an opening that is dimensioned for the NV microphone to slide therewithin, the opening having a plurality of friction wiper blades that come into contact with the NV microphone when it slides within the bracket.

15 Claims, 1 Drawing Sheet

NOISE-VIBRATION MICROPHONE STAND

FIELD OF THE INVENTION

The present invention is related to a noise-vibration microphone stand, and in particular, to a noise-vibration microphone stand for holding a noise-vibration microphone a predetermined distance from a surface that the stand is attached to.

BACKGROUND OF THE INVENTION

Noise-vibration (NV) microphones can be used to measure noise and vibration from a surface during wind tunnel testing, vibration testing, and the like. Such NV microphones are desirably placed a specific distance from the surface to be tested such that consistent results are obtained for different test parameters, different surfaces, and the like.

Heretofore methods and apparatus used to hold NV microphones typically include a piece of wire, e.g. a piece of copper wire, that is bent into a particular shape. The copper wire is then taped to a surface to be tested and an NV microphone is glued to the wire. Thereafter, the distance from the surface to the NV microphone is adjusted by bending the wire. Such a process can take between 1 to 1.5 hours per NV microphone for installation with a total of up to 50 NV microphones having to be placed on a motor vehicle surface for a given test. Therefore, an apparatus and/or process that would afford for the convenient, consistent, and relatively quick placement of NV microphones at a predetermined distance from a surface to be tested would be desirable.

SUMMARY OF THE INVENTION

The present invention discloses a noise-vibration (NV) microphone stand for holding an NV microphone a predetermined distance from a surface that the NV microphone stand is attached to. The NV microphone stand can include a rod having an attachment end that is operable to attach to the surface to be tested with the rod extending away from the surface. In addition, an arm can be attached to and extend from the rod, the arm having an NV microphone bracket spaced apart from the rod. The NV microphone bracket can have an opening that is dimensioned for the NV microphone to slide therewithin, the opening having a plurality of friction wiper blades that come into contact with the NV microphone when it slides within the bracket.

In some instances, the attachment end of the rod can include a suction cup that is operable to attach the rod to the surface. In addition, the rod can have at least one location member that can locate and hold the arm a predefined distance from the attachment end. The at least one location member can be a spring-loaded button, an indentation on a surface of the rod or an aperture through which a pin can be placed. The arm can have a rod end oppositely disposed from the NV microphone bracket with the rod end attached to the rod and engaged with the at least one location member. In the event that the at least one location member is a spring-loaded button, the rod end can have an indentation that will engage the button. In the alternative, the rod end can have a spring-loaded button that will engage an indentation on the surface of the rod. In still another alternative, the rod end can have an aperture that aligns with an aperture in the rod and affords for a pin, rod, bolt, etc. to extend through the aligned apertures and attach the arm to the rod.

An NV microphone can also be included and have a generally elongated rod shape with an outer surface that has a portion that is relatively rough such that an outer friction surface on the NV microphone is provided. The outer friction surface can be integral with the outer surface of the NV microphone or, in the alternative, can be a piece of friction tape wrapped around at least part of the NV microphone.

A process for holding the NV microphone a predefined distance from a surface during noise and vibration testing is also disclosed. The process includes providing an NV microphone and an NV microphone stand as described above. Thereafter, the NV microphone is placed at least partially within the opening of the NV microphone stand arm with the plurality of friction wiper blades contacting the NV microphone and providing an interference fit therebetween. In addition, either before or after the NV microphone is placed within the opening, the attachment end of the rod is attached to the surface to be tested. It is appreciated that the exact distance that an end of the NV microphone is located from a surface to be tested can be adjusted by sliding the microphone within the NV microphone bracket and/or adjusting the location of the rod end of the arm along the rod.

DETAILED DESCRIPTION OF THE PRESENT INVENTION

The present invention discloses a microphone stand for a noise-vibration (NV) microphone that holds the NV microphone a predetermined distance from a surface to be tested. As such, the NV microphone stand has utility as a testing component.

The NV microphone stand affords for an NV microphone to be conveniently and relatively quickly positioned a predetermined distance from a surface to undergo noise and vibration testing. The stand can have a suction cup attached to a rod, the suction cup affording for the rod to be attached to a surface in a relatively quick and consistent manner known to those skilled in the art. Attached to the rod is an arm that has an NV microphone bracket spaced apart from the rod and dimensioned to hold the NV microphone. In particular, the NV microphone bracket can have an opening that is dimensioned for the microphone to slide therewithin. In addition, the opening of the NV microphone bracket can have a plurality of friction wiper blades that extend from a side wall inwardly towards a central axis of the opening. It is appreciated that the plurality of friction wiper blades can come into contact with the NV microphone as it slides within the opening and thereby provide an improved and/or increased interference fit between the bracket and the microphone.

The rod that is attached to the surface to be tested can have at least one location member that affords for the arm to be spaced a desired distance from the surface. In this manner, the height of the arm and thus the NV microphone can be adjusted either before and/or after the rod has been attached to the surface.

Figure 1:
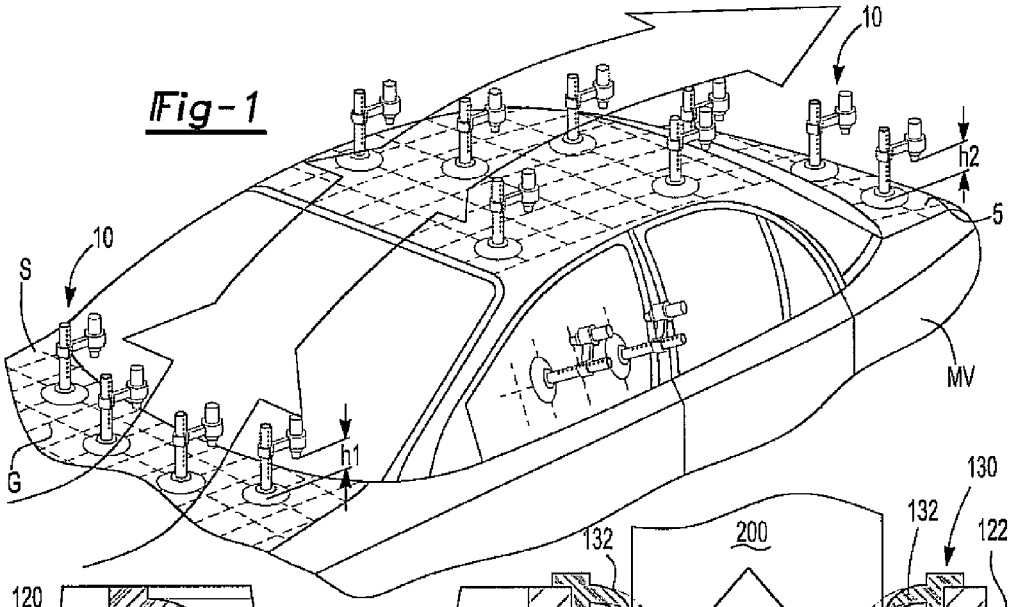
FIG. 1 is an illustration of a plurality of noise-vibration (NV) microphone stands holding NV microphones and attached to a surface of a motor vehicle to be tested.

Turning now to FIG. 1, a schematic illustration of a motor vehicle MV having a surface S with a grid G thereon is shown. The large arrow in the figure can represent air flowing over the surface 5, for example during wind tunnel testing. Also shown in the figure, a plurality of NV microphone stands 10 can be attached to the surface S at predefined locations relative to the grid G. In addition, one or more stands 10 can be attached to a glass surface such as a windshield, a window and the like. Each of the NV microphone stands 10 can hold an NV microphone a predetermined distance h1, h2, etc. from the surface. In this manner, a plurality of NV microphones can be located proximate to the surface S and used to measure noise and/or vibration during testing of the motor vehicle MV. It is appreciated that other surfaces such as interior surfaces of the motor vehicle MV can also be tested with one or more NV microphone stands 10 attached thereto. It is also appreciated that the microphone stands 10 can be used to test other surfaces than those associated with a motor vehicle.

Figure 2:
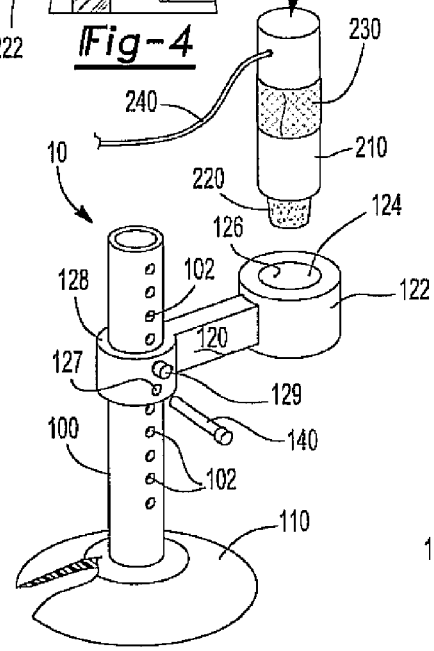
FIG. 2 is an illustration of an NV microphone stand according to an embodiment of the present invention.

Referring now to FIG. 2, the NV microphone stand 10 can include a rod 100 having an attachment end 110. In some instances, the attachment end 110 can be a suction cup that affords for the attachment of the rod 100 to a surface by simply pushing on the rod, and thus on the suction cup 110, as is known to those skilled in the art. In this manner, a vacuum can be created between the surface and an inner surface of the suction cup which can hold the rod 100 and thus the NV microphone stand 10 at a desired location.

Figure 4:
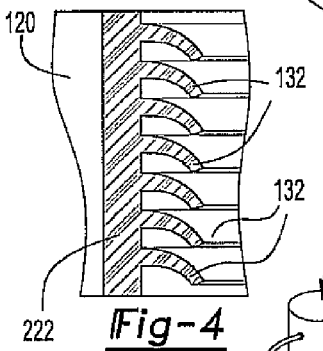
FIG. 4 is a cross sectional of an NV microphone bracket according to an embodiment of the present invention.
Figure 3:
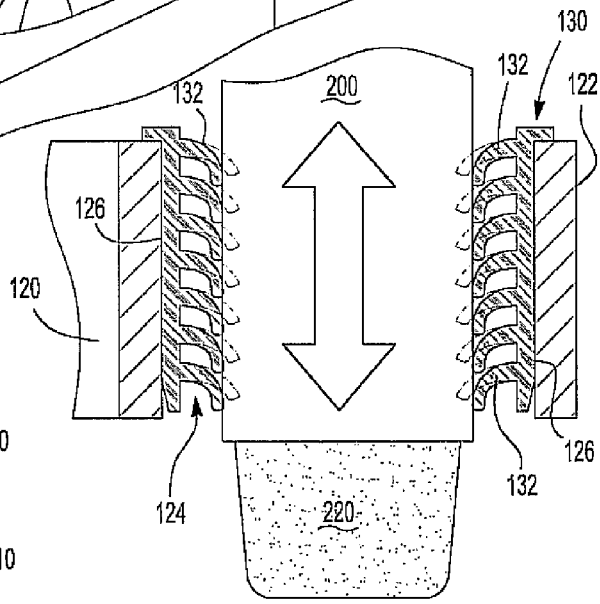
FIG. 3 is a cross sectional enlarged view of an NV microphone bracket and NV microphone according to an embodiment of the present invention.

Attachable to the rod 100 can be an arm 120, the arm 120 having an NV microphone bracket 122 and a rod end 128. The NV microphone bracket 122 is spaced apart a predetermined distance from the rod end 128, and thus from the rod 100, and can have an opening 124 that is dimensioned for a NV microphone 200 to slide at least partially therewithin. The opening 124 can have a side wall 126 with a plurality of friction wiper blades 132 extending therefrom as shown in FIGS. 3 and 4. In some instances, the plurality of friction wiper blades 132 are part of an insert 130 placed within the opening 124, however this is not required. For example, the plurality of friction wiper blades 132 can be integral with a NV microphone bracket 222 as shown in FIG. 4. In any event, the NV microphone 200 can slide at least partially up and down within the NV microphone bracket 122 as shown by the arrow 1 in FIG. 3. In this manner, the exact distance of a microphone end 220 held from a surface S can be adjusted.

Figure 5:
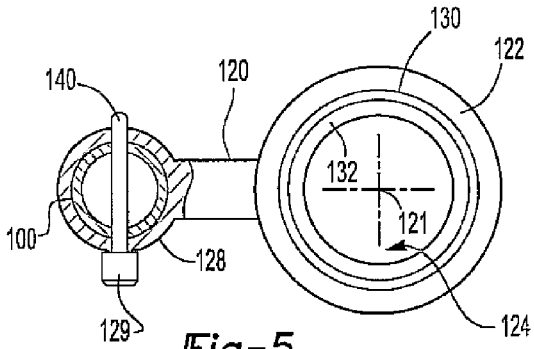
FIG. 5 is a top view of the NV microphone stand shown in FIG. 2.

Additional adjustment can be afforded by at least one location member 102 on the rod 100. The location member 102 can be an indentation on the surface of the rod 100, an aperture at least partially through the rod 100, a spring-loaded button extending from the surface of the rod 100, a knob or bump extending from the rod of the surface 100, and the like. Given the particular shape, size, etc. of the at least one location member for the rod 100, the rod end 128 of the arm 120 can have a corresponding and complementary engagement feature that engages or interacts with the location member to hold the arm at a desired location. For example, if the at least one location member is an indentation on the surface of the rod 100, the rod end 128 can have a spring-loaded button 129 that engages with the indentation. In the alternative, the rod end 128 can have an indentation that engages with a spring-loaded button extending from the rod 100. In another alternative, both the rod 100 and the rod end 128 can have an aperture 102, 127, respectively, that can be aligned with each other such that a pin 140 can extend therethrough as shown in FIGS. 2 and 5.

The NV microphone 200 can have an outer surface 210, the outer surface 210 having at least a portion thereof that is a friction surface 230. The friction surface 230 can be integral with the outer surface 210, or in the alternative not be integral with the outer surface, for example be a piece of friction tape. It is appreciated that the friction surface 230 can interact or engage with the plurality of friction wiper blades 132 to afford for an improved grip between the NV microphone bracket 122 and the NV microphone 200. In some instances, the NV microphone 200 can have an electrical conductive lead 240 extending therefrom, however this is not required. Stated differently, the microphone 200 can wirelessly communicate with a receiver (not shown).

A process for holding the NV microphone 200 at a predefined distance from a surface during noise and vibration testing is also provided. The process can include providing the NV microphone 200 and the NV microphone stand 10. Either before or after the NV microphone stand 10 is attached to a surface, the NV microphone 200 can be placed at least partially within the NV microphone bracket 122. It is appreciated that the NV microphone stand 10 can be attached to a surface using any method, process, or technique known to those skilled in the art, illustratively including the suction cup 110, adhesives, welding, and the like. It is further appreciated that a plurality of NV microphone stands 10 with a plurality of NV microphones 200 can be preassembled on a bench and thereafter placed on a surface. After the NV microphone 200 is held or positioned adjacent to the surface, a distance between the microphone end 220 and the surface can be conveniently adjusted if desired by sliding the NV microphone 200 within the bracket 122 and/or moving and attaching the rod end 128 up or down along the rod 100. In this manner, time and effort can be reduced for the noise-vibration testing of the surface.

The invention is not restricted to the illustrative examples described above. The examples are not intended as limitations on the scope of the invention. Methods, processes, apparatus, compositions, and the like described herein are exemplary and not intended as limitations on the scope of the invention. Changes herein and other uses will occur to those skilled in the art. The scope of the invention is defined by the scope of the claims.

I claim:

1. A noise-vibration (NV) microphone stand for holding an NV microphone a predetermined distance from a surface that the NV microphone stand is attached to, the NV microphone stand comprising:

a rod having an attachment end operable to attach to the surface with said rod extending away from said surface, said rod having at least one location member operable to locate and hold said arm a predefined distance from said attachment end;

an arm attached to and extending from said rod, said arm having an NV microphone bracket spaced apart from said rod, said arm having a rod end oppositely disposed from said NV microphone bracket, said rod end attached to said rod and engaged with said location member;

said NV microphone bracket having an opening dimensioned for the NV microphone to slide therewithin, said opening having a plurality of friction wiper blades dimensioned to contact the NV microphone when the NV microphone slides within the opening, for the purpose of securely holding the NV microphone within the NV bracket.

2. The NV microphone stand of claim 1, wherein said attachment end of said rod has a suction cup operable to attach said rod to the surface.

3. The NV microphone stand of claim 1, wherein said at least one location member is a spring-loaded button located a predetermined distance from said attachment end.

4. The NV microphone stand of claim 1, wherein said at least one location member is an indentation on a surface of said rod and located a predetermined distance from said attachment end.

5. The NV microphone stand of claim 1, wherein said opening of said NV microphone bracket is an aperture extending through said bracket and said plurality of friction wiper blades extend inwardly from a side wall to a central axis of said aperture.

6. The NV microphone stand of claim 1, further comprising an NV microphone having a generally elongated rod shape and an outer friction surface.

7. The NV microphone stand of claim 6, wherein said outer friction surface is a friction tape wrapped around at least part of said NV microphone.

8. A process for holding a noise-vibration (NV) microphone a predefined distance from a surface during noise and vibration testing of the surface, the process comprising:

providing an NV microphone;

providing an NV microphone stand having:

a rod having an attachment end operable to attach to the surface with the rod extending away from said surface;

an arm attached to and extending from the rod, the arm having an NV microphone bracket spaced apart from the rod, the arm also having a rod end dimensioned to slide up and down the rod;

the rod having at least one location member operable to locate and hold the rod end of the arm a predefined distance from the surface when the attachment end is attached to the surface, the at least one location member being a first aperture through the rod and the rod end has a second aperture that can be aligned with the first aperture, the first and second apertures dimensioned for a pin to slide through;

the NV microphone bracket having an opening dimensioned for the NV microphone to slide therewithin, said opening having a plurality of friction wiper blades dimensioned to contact the NV microphone when the NV microphone slides within the opening;

placing the NV microphone at least partially within the opening, the plurality of friction wiper blades contacting the NV microphone and providing an interference fit therebetween; and attaching the attachment end to the surface, the NV microphone being a predefined distance from the surface.

9. The process of claim 8, further including the attachment end of the rod having a suction cup and attaching the NV microphone stand to the surface by pushing the suction cup against the surface.

10. The process of claim 8, wherein the at least one location member is a spring-loaded button located a predetermined distance from the attachment end and the rod end has an indentation dimensioned to engage the spring-loaded button.

11. The process of claim 8, wherein the at least one location member is an indentation on a surface of said rod and located a predetermined distance from said attachment end and the rod end has a spring-loaded button dimensioned to engaged the indentation.

12. The process of claim 8, further including a pin dimensioned to slide at least partially through the first and second apertures, and locate and hold the rod end of the arm a predefined distance from the surface when the attachment end is attached to the surface.

13. The process of claim 8, wherein the opening of the NV microphone bracket is an aperture extending through the bracket and the plurality of friction wiper blades extend inwardly from a side wall to a central axis of the aperture.

14. The process of claim 8, wherein the NV microphone has an outer friction surface.

15. The process of claim 14, wherein the outer friction surface is a piece of friction tape attached to the NV microphone.

* * * * *